US007357399B1

(12) United States Patent
Klotz

(10) Patent No.: US 7,357,399 B1
(45) Date of Patent: Apr. 15, 2008

(54) POST HOLE DIGGER STAND

(76) Inventor: John S. Klotz, 21722 Enyenhausen Rd., Creal Springs, IL (US) 62922

( * ) Notice: Subject to any disclaimer, the term of this patent is extended or adjusted under 35 U.S.C. 154(b) by 226 days.

(21) Appl. No.: 11/191,532

(22) Filed: Jul. 28, 2005

(51) Int. Cl.
*B62B 3/10* (2006.01)

(52) U.S. Cl. ..... 280/79.11; 280/47.34; 248/676; 269/17

(58) Field of Classification Search ..... 280/47.34, 280/79.11, 79.4, 79.6, 79.7, 35; 248/648, 248/673, 676, 123.11, 125.1, 125.8; 175/323, 175/170; 269/17
See application file for complete search history.

(56) References Cited

U.S. PATENT DOCUMENTS 1,169,157 A * 1/1916 Honold ..... 211/174
2,815,566 A 12/1957 Hille ..... 29/288
2,825,477 A * 3/1958 Ross ..... 29/559
2,827,690 A * 3/1958 Brown ..... 269/17
4,032,165 A * 6/1977 Russell ..... 280/79.3
4,601,348 A * 7/1986 Cox ..... 173/25
5,586,743 A 12/1996 Sodolak ..... 248/671
5,660,637 A * 8/1997 Dodge ..... 118/500
5,678,801 A 10/1997 Billingsley ..... 248/676
6,419,245 B1 7/2002 Trimble ..... 280/79.11
6,742,747 B1 6/2004 Timmons, Jr. ..... 248/139

* cited by examiner

*Primary Examiner*—Christopher Bottorff
(74) *Attorney, Agent, or Firm*—Grace J. Fishel

(57) ABSTRACT

A post hole digger stand for supporting a post hole digger assembly. The stand has a planar base mounted on surface engaging members such as steerable casters. A pair of vertical support arms are mounted on the base with a transverse movable support bar mounted on the support arms for supporting the post hole digger assembly balanced along a curved section of its boom. A brace may be provided to keep post hole digger assembly from rocking on the movable support bar.

8 Claims, 6 Drawing Sheets

POST HOLE DIGGER STAND

BACKGROUND OF THE INVENTION

1. Field of the Invention

The present invention relates to a post hole digger stand that allows a single person to connect or disconnect a post hole digger assembly to and from a tractor or other similar vehicle.

2. Brief Description of the Prior Art

Connecting and disconnecting a post hole digger assembly to and from a tractor is a difficult task, due to the size and weight of the assembly. Typically, the job requires at least three individuals. Two people to support the device and one to make the required connections. There are times, however, when help is not available.

There have been post hole digger stands developed in the past that address the above-mentioned problem. Most are sized or adjusted in size to fit a particular make or model of post hole digger assembly. What is needed is a post hole digger stand that is adapted for use with different makes and models of post hole digger assemblies without adjustment for differences in boom length and the like. It would also be desirable to have a post hole digger stand that can be easily moved into alignment with the tractor to facilitate connecting and disconnecting the post hole digger assembly.

BRIEF SUMMARY OF THE INVENTION

In view of the above, it is an object of the present invention to provide a post hole digger stand that can be used with conventional post hole digger assemblies without adjusting the length of the base for different sized booms. It is another object to provide a post hole digger stand that is mounted on surface engaging members that allow the stand to be easily aligned with a tractor during connecting or disconnecting of the post hole digger assembly to a three-point hitch. Other objects and features of the invention will be in part apparent and in part pointed out hereinafter.

In accordance with the invention, a post hole digger stand is provided for a post hole digger assembly having a boom and an auger assembly. The boom has first and second arms joined by a curved section. The first arm is connected to a central lift arm of a three-point hitch and the second arm is pivotally connected to the auger assembly. The boom is mounted on a yoke with arms that are connected to the trailing arms of the three-point hitch. The auger assembly includes a gear box connected to a drive shaft and to an auger.

The post hole digger stand has a transverse base which may be formed of longitudinal side rails interconnected at opposite ends with transverse end rails. The base is mounted on surface engaging members which are preferably steerable. A pair of vertical support arms are mounted on the base. A transverse movable support bar is mounted on the support arms for supporting the post hole digger assembly balanced along the curved section of the boom. A brace may be provided for keeping the post hole digger assembly from swaying on the support bar.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
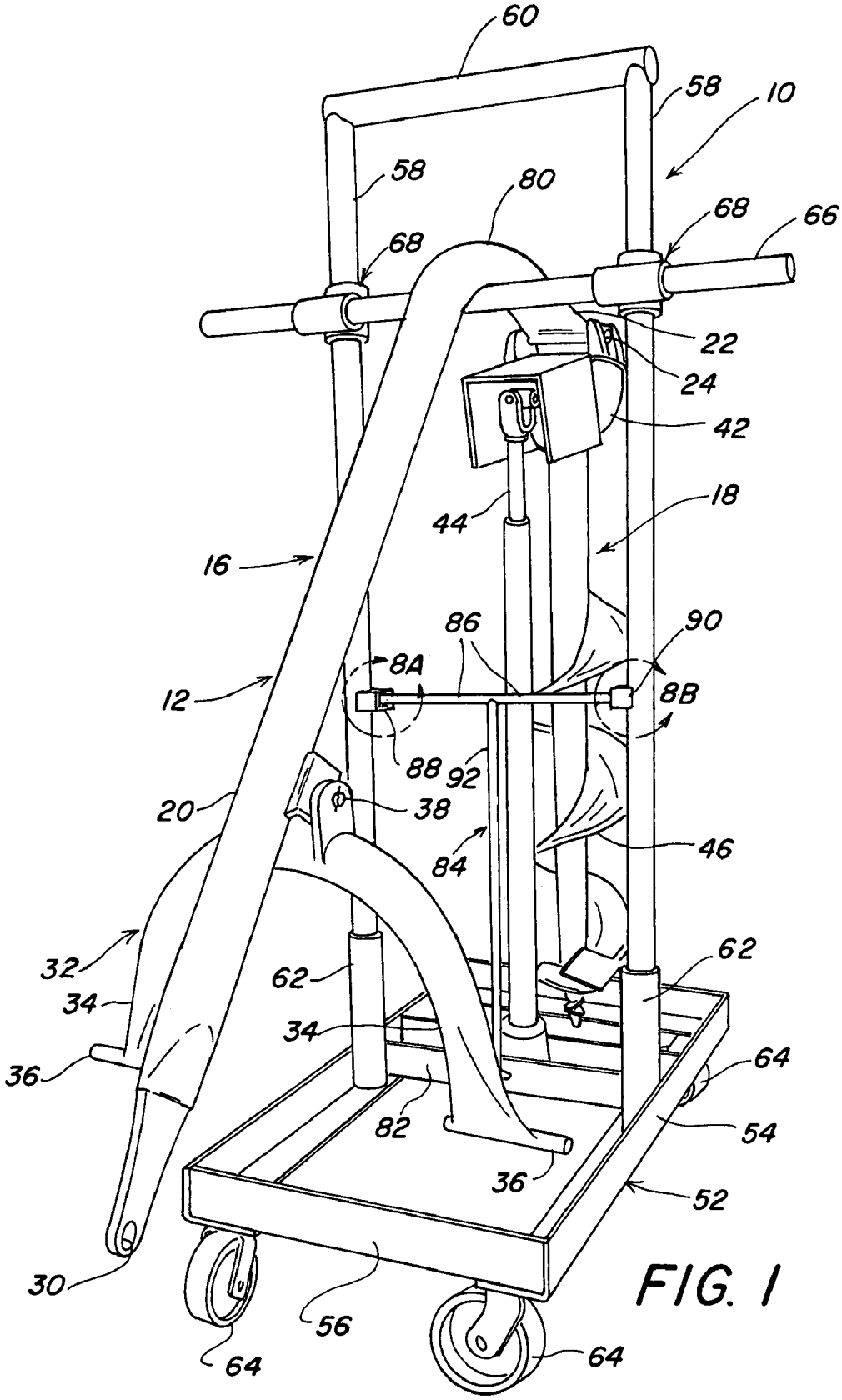
FIG. 1 is a front perspective view of a conventional post hole digger assembly mounted on a movable support bar of a post hole digger stand in accordance with the present invention.
Figure 3:
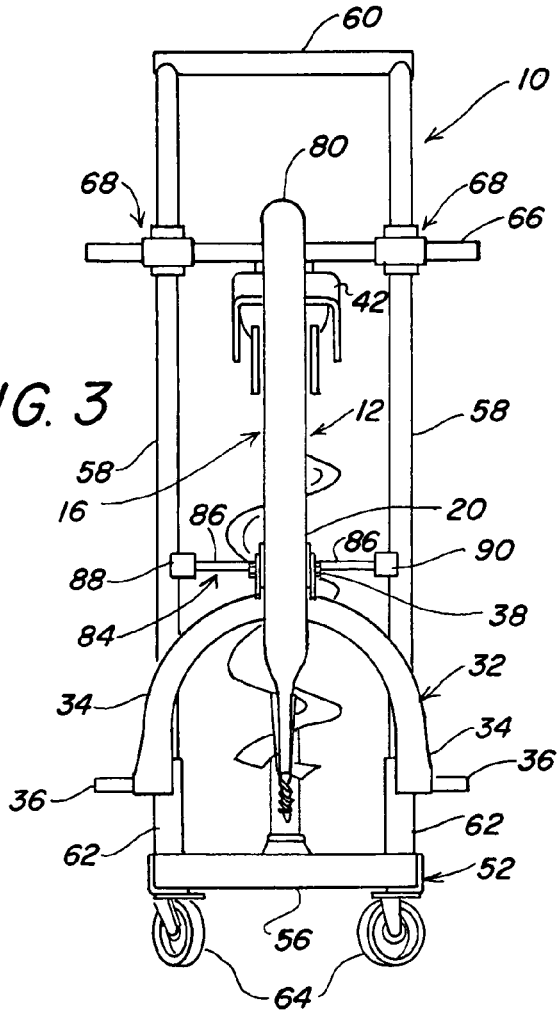
FIG. 3 is front elevation of the post hole digger assembly mounted on the post hole digger stand.
Figure 2:
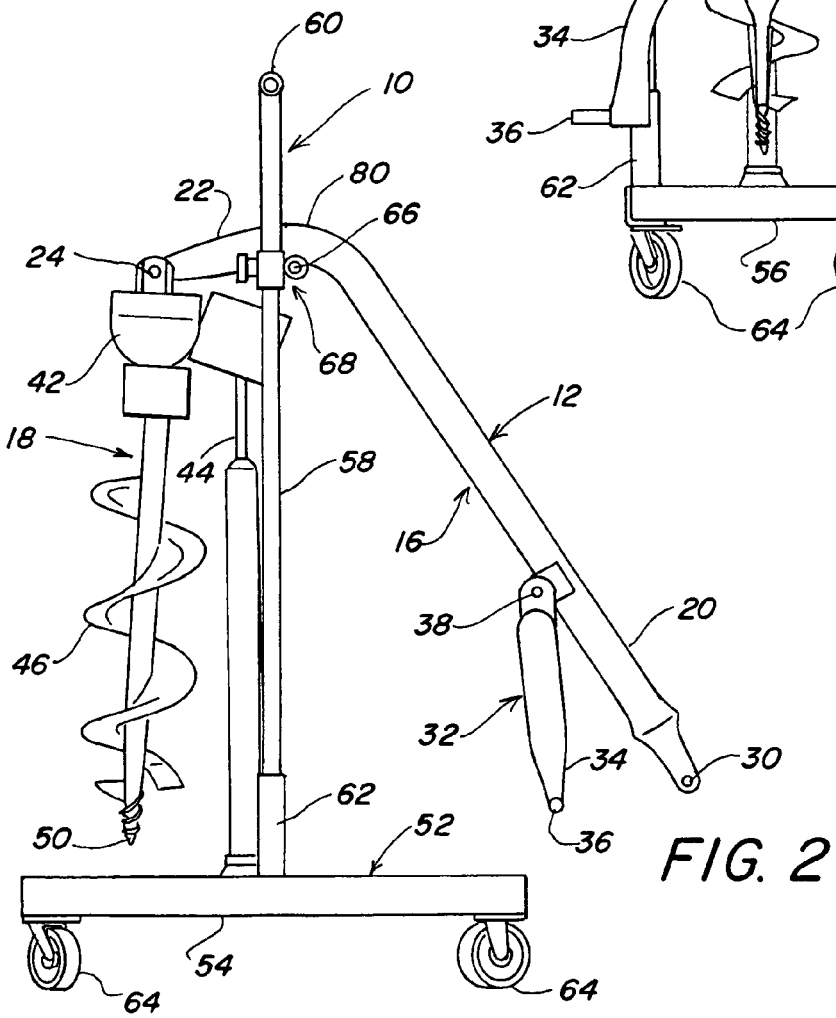
FIG. 2 is a side elevation of the post hole digger assembly shown mounted on the post hole digger stand.

Referring to the drawings more particularly by reference character, reference numeral 10 refers to a post hole digger stand in accordance with the present invention. Post hole digger stand 10 may be used to mount, dismount, store or repair a conventional post hold digger assembly 12 adapted for attachment to a three-point hitch at the rear of a tractor 14 or like vehicle. Since post hole auger assembly 12 is conventional, only those portions which interact with post hole digger stand 10 are described herein.

Post hole auger assembly 18 includes a curved boom 16 and an auger assembly 18. Boom 16 has first and second arms 20, 22 wherein second arm 22 (i.e., the arm more distant from tractor 14) is shorter than first arm 20. A free end of second arm 22 is pivotally connected at 24 to auger assembly 18 and a free end of first arm 20 is adapted to be removably attached to a central lift arm 26 of the three-point hitch with a pin 28 that passes through a hole 30 in lower end of first arm 20. Boom 16 is mounted on a yoke 32 subassembly that includes a pair of arms 34 with outwardly protruding pins 36. Yoke 32 is pivotally connected at 38 to a mid-portion of first arm 20 and pins 36 are adapted to be received in trailing arms 40 of the three-point hitch.

Auger assembly 18 includes a gear box 42 through which a drive shaft 44 is coupled to an auger 46. Drive shaft 44 is adapted to be connected to a power take-off 48 of tractor 14. Auger 46 includes a central portion surrounded by a helical blade which terminates at tip 50.

Post hole digger stand 10 has a generally planar base 52 that may be formed of spaced apart longitudinal side rails 54 joined at opposite ends by transverse end rails 56. A pair of vertical support arms 58 extend upwardly from side rails 54 along a mid-point thereof. An upper end of support arms 58 is joined by a cross-bar 60. When support arms 58 are formed of tubular material and side and end rails 54, 56 are formed of angle iron, a tubular receiver 62 of slightly larger internal diameter than the external diameter of support arms 58 may be affixed to each of side rails 54 for sliding receipt of support arms 58. Base 52 is mounted on surface engaging members 64 which permit the base to moved across a shop floor or other surface. While skids may be used, it is preferred that surface engaging members 64 be steerable. Suitable surface engaging members 64 for this purpose include swivel casters, ball-in-socket casters and the like, typical ones of which are shown in McMaster-Carr Supply Company, Catalog 108, which is incorporated by reference herein. As shown therein, surface engaging members 64 may be outfitted with a brake.

Figure 5B:
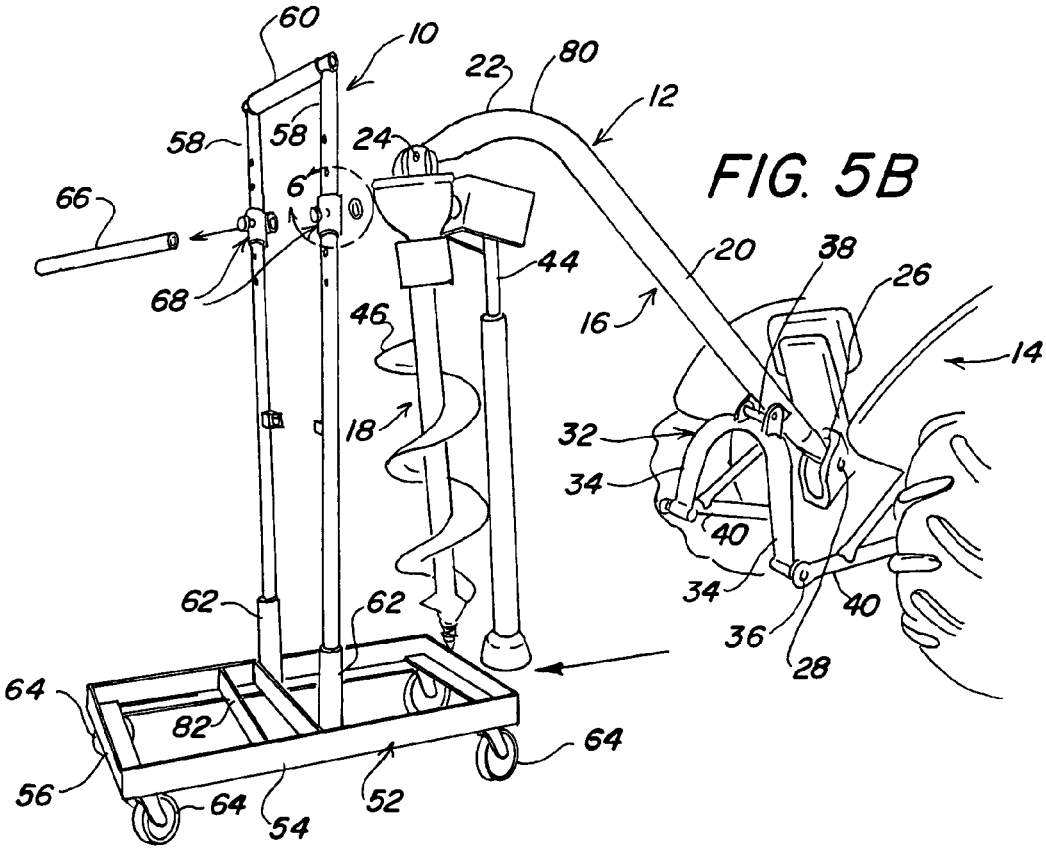
FIG. 5B is a perspective view of the post hole digger assembly connected to the three-point hitch of the tractor with the post hole digger stand being rolled away.
Figure 6:
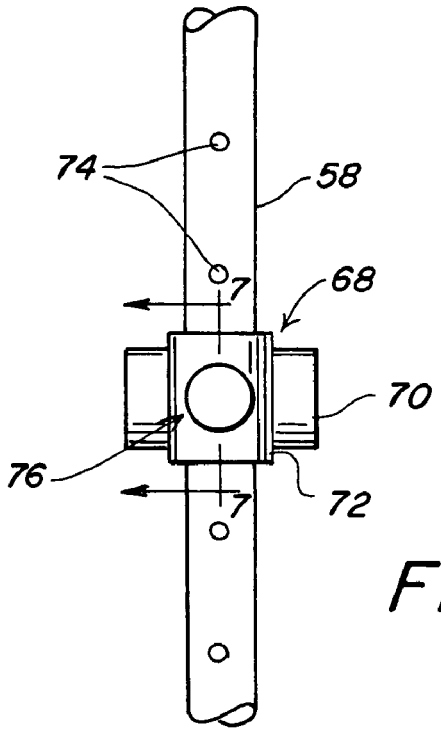
FIG. 6 is a detail taken along line 6-6 in FIG. 5B showing the movable support bar mounted on a movable member.
Figure 7:
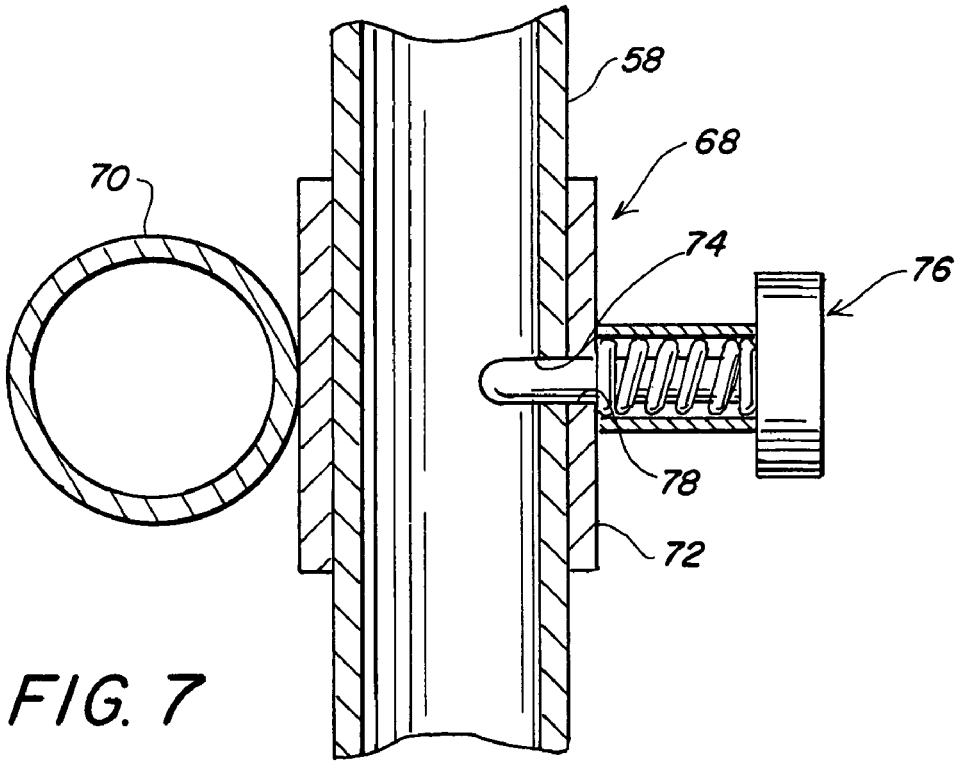
FIG. 7 is a cross-section taken along the plane of 7-7 in FIG. 6.

A transverse movable support bar 66 is mounted on support arms 58 between base 52 and cross bar 60. Movable support bar 66 can be adjusted in height with respect to base 52 and is also removable (FIG. 5B) as described below. As illustrated in the drawings (FIGS. 6-7), movable support bar 66 is mounted on movable members 68. As seen in FIGS. 6-7, movable members 68 may be tubular receivers 70, each of which is affixed to a collar 72 which slides over one of support arms 58. A plurality of holes 74 are formed in support arms 58 matable with a spring biased pin 76 mounted on collar 72. Pin 76 passes through a hole 78 in collar 72 and a selected one of holes 74 in support arms 58 for vertical adjustment of receivers 70 whereby movable support bar 66 may be adjusted in height with respect to base 52.

As shown in FIGS. 1-4, post hole digger assembly 12 is stably suspended along a curved section 80 of boom 16 between first and second arms 20, 22 on movable support bar 66. In this position, auger assembly 18 is pivoted by gravity about pivot 24 such that auger 46 and drive shaft 44 are generally vertical with tip 50 suspended above base 52. A free end of drive shaft 44 may be received in a receiver such as transverse channel 82 mounted between side rails 54 on that side of vertical support arms 58 distal tractor 14. In this position, post hole digger assembly 12 may be rolled or skidded across a shop floor or other supporting surface. As long as movable support bar 66 is high enough to support auger 46 above base 52, post hole digger stand 10 may be used with any conventional post hole digger assembly 12 without regard to the length of boom 16, size of auger assembly 18, etc.

Figure 8:
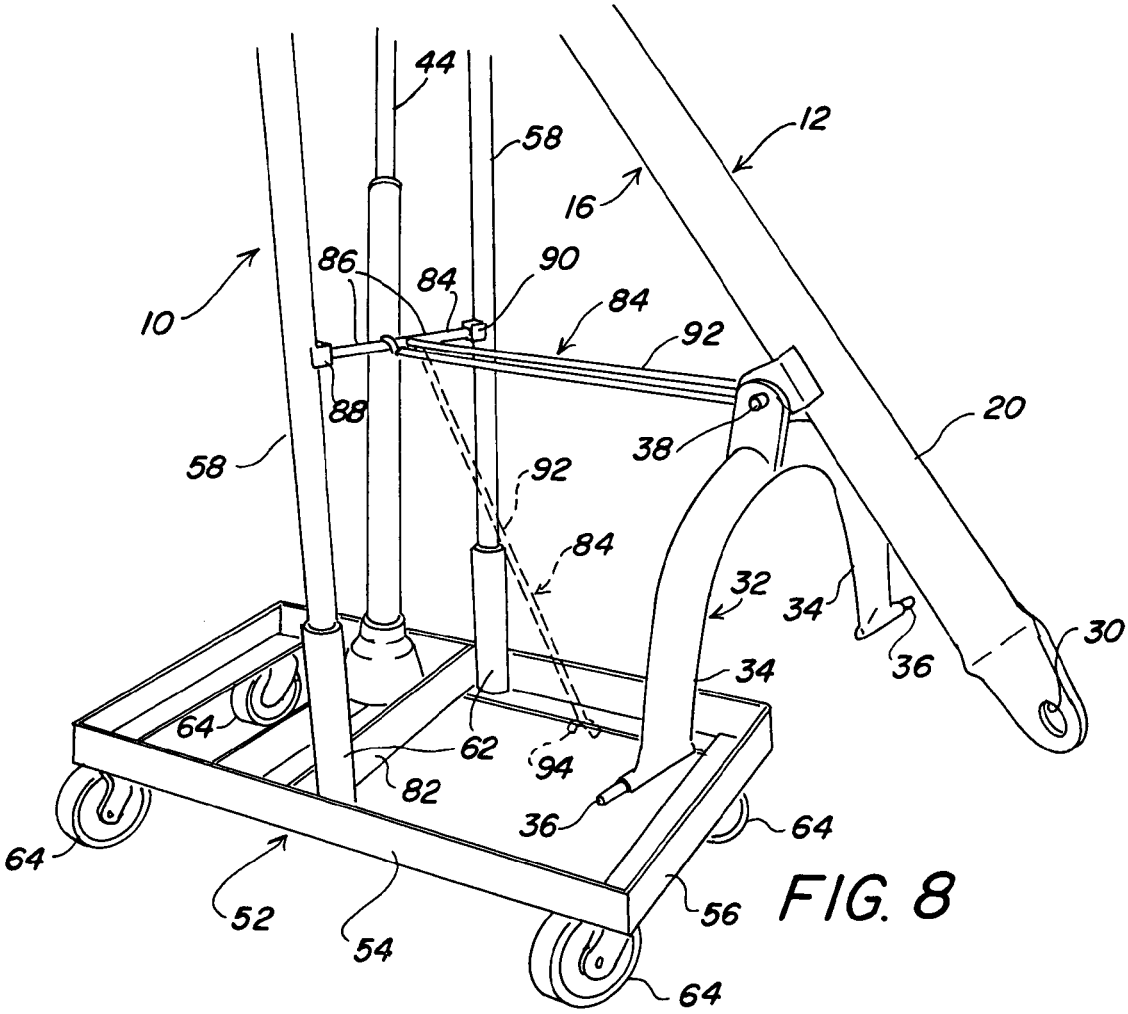
FIG. 8 is a enlarged, partially broken away, perspective view of the post hole digger assembly mounted on the post hole digger stand illustrating the use of a brace for stabilizing the post hole digger assembly.
Figure 8A:
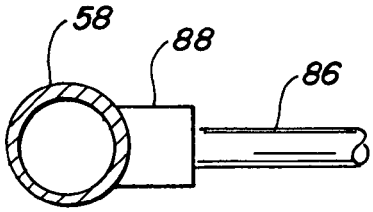
FIG. 8A is a detail taken along line 8A-8A in FIG. 1 showing one of the receivers for mounting the brace; and, FIG. 8B is a detail taken along line 8B-8B in FIG. 1 showing a second of the receivers for mounting the brace.
Figure 8B:
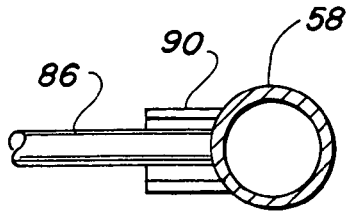

A brace 84 may be provided to prevent post hole digger assembly 12 from swaying on post hole digger stand 10. Brace 84 as shown in the drawings is T-shaped with arms 86 which are received in receivers 88, 90, details of which are shown in FIGS. 8A-8B, provided on upright support arms 58. A stem 92 of T-shaped brace 84 terminates with a saddle 94 which fits over pivot 38 of yoke 32. At rest, brace 84 hangs stem 92 down in receivers 88, 90. As shown in FIG. 8, brace 84 may be rotated in receivers 88, 90 and saddle 94 on pivot 38. A bungee cord 96 or the like may be provided to keep pivot 38 seated in saddle 94. Alternatively, saddle 94 may clamp on pivot 38 obviating the need for cord 96. As shown in FIGS. 8A and 8B, receiver 88 is open ended while receiver 90 is both open ended and open topped such that arms 86 of brace 84 may be installed and removed from between upright support arms 58. During installation of brace 84 on post hole digger stand 10, one of arms 86 is inserted into open ended receiver 88 (FIG. 8A) and then the other of arms 86 is dropped through open top of receiver 90 (FIG. 8B). The steps are reversed to remove brace 84.

Figure 4:
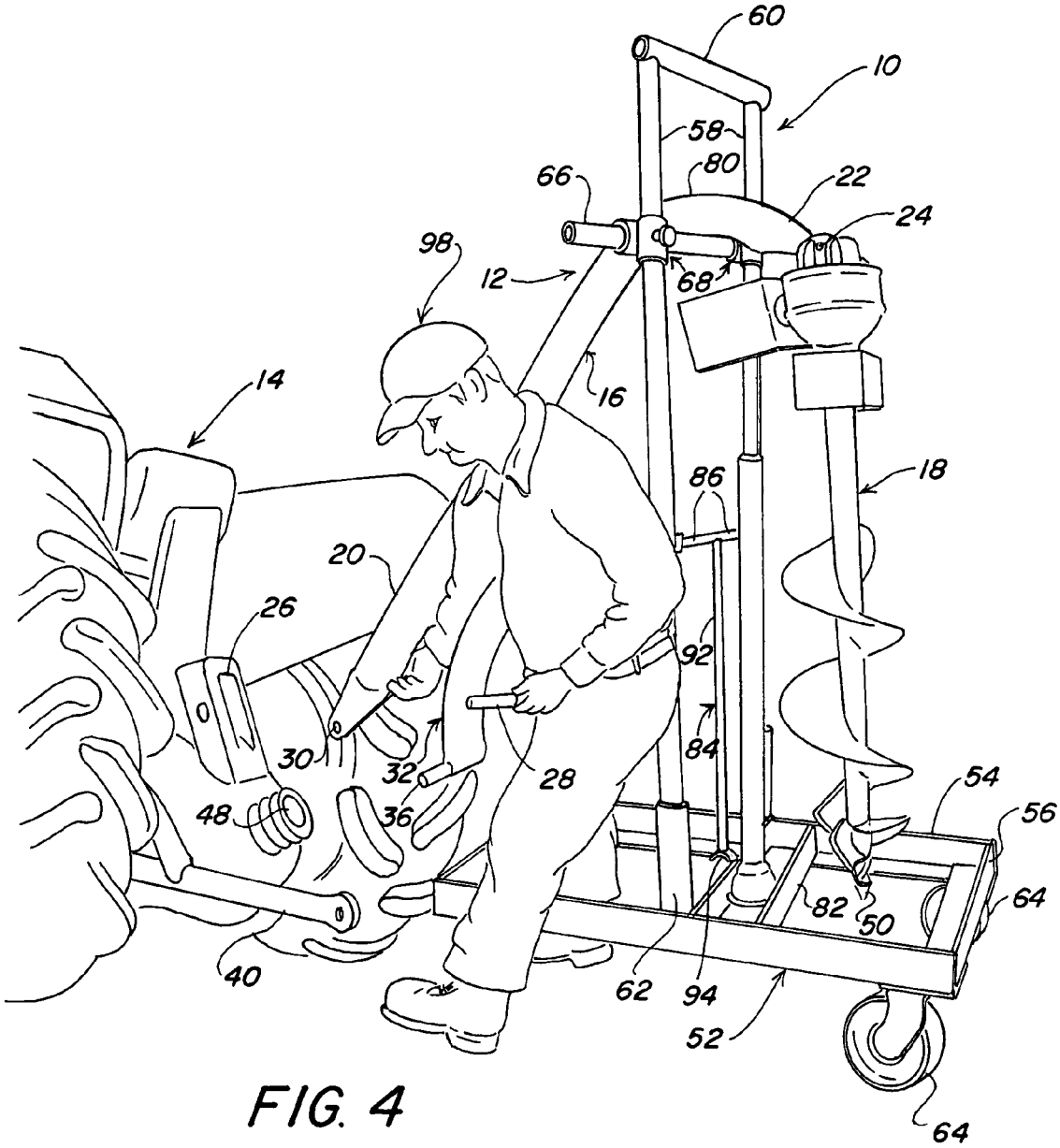
FIG. 4 is a perspective view of an operator attaching the post hole digger assembly to a three-point hitch on a tractor with the post hole digger assembly supported on the post hole digger stand.

In use, when it is desired to mount post hole digger assembly 12 on tractor 14 as shown in FIG. 4, post hole digger stand 10 is wheeled or skidded into position behind the tractor. Steerable surface engaging members 64 allow post hole digger stand 10 to be readily moved into position behind tractor 14. With brace 84 and cord 96 released, a single operator 98 can pivot boom 16 on support bar 66 such that hole 30 in boom 16 is aligned with central lift arm 26 and coupled with pin 28. During this operation, the weight of post hole digger assembly 12 is on support bar 66 and boom 16 may be manipulated single handed by operator 98. Pins 36 of yoke 32 are then received in trailing arms 40 of the three point hitch. Brace 84 is removed from post hole digger stand 10, if not previously removed, and drive shaft 44 attached to power take-off 48 on tractor 14.

Figure 5A:
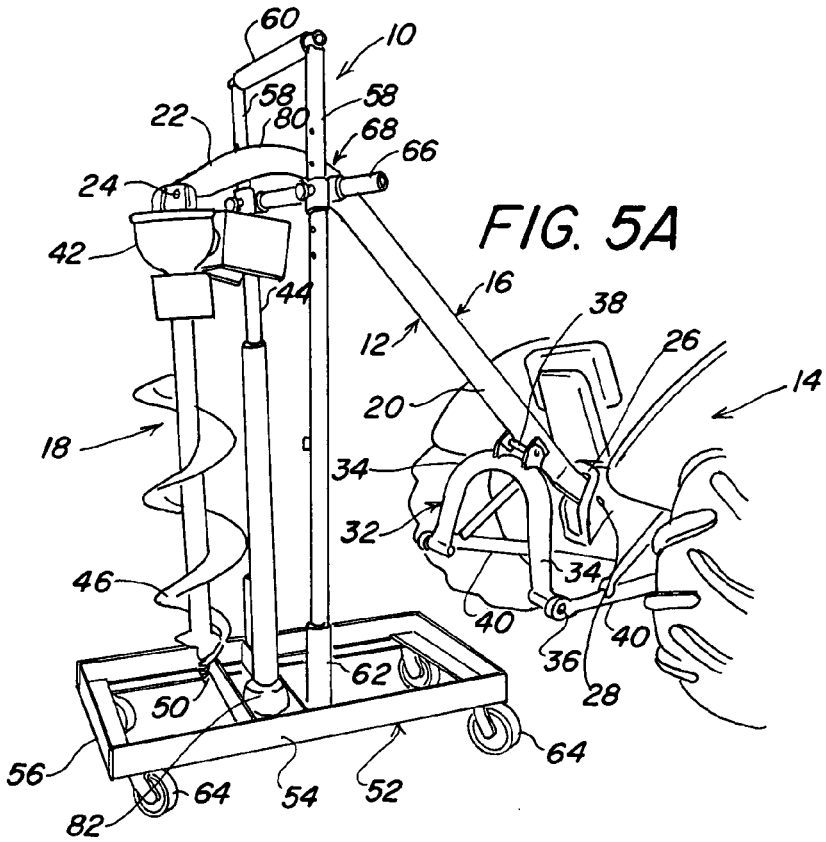
FIG. 5A is a perspective view of the post hole digger assembly shown lifted away from the movable support bar.

With the above connections complete, operator 98 may start tractor 14 and lift boom 16 such that curved section 80 of boom 16 is elevated above support bar 66 as shown in FIG. 5. In this condition, movable support bar 66 is removed from movable members 68 and post hole digger stand 10 may be rolled or skidded away from tractor 14 or tractor 14 may be driven away, leaving post hole digger stand 10 behind. After use, post hole auger assembly 12 may be disconnected from tractor 14 and maintained in upright position, relieving operator 98 from the task of lowering post hole auger assembly 12 to the ground, by reversing the above steps: Post hole digger assembly 12 is raised with three point hitch so that tip 50 of auger 46 is suspended above the support surface. Steerable surface engaging members 64 allow post hole digger stand 10 to be moved into position behind tractor 14 such that vertical support arms 58 flank curved section 80 of boom 16. Movable support bar 66 is inserted into movable members 68 and movable members 68 are adjusted along support arms 58 so that movable support bar 66 is under curved section 80. Post hole digger assembly 12 is low lowered with three point hitch until boom 16 rests upon movable support bar 66 relieving the pressure on pins 36 and pin 28 which connect yoke 32 and boom 16 to three-point hitch, respectively. Pins 36 and pin 28 are disconnected and tractor 14 may be driven away, leaving post hole auger assembly 12 suspended on post hole digger stand 10. Brace 84 and cord 96 may be attached to keep post hole digger assembly from rocking on movable support bar 66, if desired.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A post hole digger stand for supporting a post hole digger assembly, said post hole digger assembly comprising a boom and an auger assembly, said boom having first and second arms joined by a curved section, said second arm pivotally connected to the auger assembly, said auger assembly including a gear box connected to a drive shaft and to an auger, said post hole digger stand comprising a transverse base mounted on surface engaging members which permit the base to be moved across the surface; and, a pair of vertical support arms extending from the base, a transverse movable support bar mounted on the support arms for supporting the post hole digger assembly balanced along the curved section of the boom, said movable support bar mounted on movable members, each movable member comprising a collar that is slidable along the vertical support arms and a tubular receiver mounted on the collar for sliding receipt of said transverse movable support bar whereby the transverse movable support bar is removable during loading and unloading the post hole digger assembly on the post hole digger stand.

2. The post hole digger stand of claim 1 wherein the surface engaging members are swivel casters.

3. A post hole digger stand for supporting a post hole digger assembly, said post hole digger assembly comprising a boom and an auger assembly, said boom having first and second arms joined by a curved section, said second arm pivotally connected to the auger assembly, said boom further including a yoke which is pivoted along a mid-point of the first arm, said auger assembly including a gear box connected to a drive shaft and to an auger, said post hole digger stand comprising a transverse base having a pair of spaced apart side rails joined at opposite ends by transverse end rails, said base mounted on steerable casters which permit the base to be moved across the surface; and, a pair of vertical support arms extending from the side rails, a transverse movable support bar mounted on the support arms for supporting the post hole digger assembly balanced along the curved section of the boom, said movable support bar mounted on movable members each movable member comprising a collar that is slidable along the vertical support arms and a tubular receiver mounted on the collar for sliding receipt of said transverse movable support bar whereby the transverse movable support bar is removable during loading and unloading the post hole digger assembly on the post hole digger stand.

4. The post hole digger stand of claim 3 further including a transverse channel mounted between the side rails for supporting a free end of the drive shaft.

5. A post hole digger stand for supporting a post hole digger assembly, said post hole digger assembly comprising a boom and an auger assembly, said boom having first and second arms joined by a curved section, said second arm pivotally connected to the auger assembly, said boom further including a yoke which is pivoted along a mid-point of the first arm, said auger assembly including a gear box connected to a drive shaft and to an auger said post hole digger stand comprising a transverse base having a pair of spaced apart side rails joined at opposite ends by transverse end rails, said base mounted on steerable casters which permit the base to be moved across the surface; and, a pair of vertical support arms extending from the side rails, a transverse movable support bar mounted on the support arms for supporting the post hole digger assembly balanced along the curved section of the boom, said post hole digger stand further including a brace to prevent the post hole digger assembly from rocking on transverse movable support bar, said brace being T-shaped with arms that are received in receivers on the support arms and a stem with a saddle into which the pivot of the yoke is seated.

6. The post hole digger stand of claim 5 wherein a cord interconnects the arms of the brace and the pivot of the yoke to keep the yoke in the saddle of the brace.

7. The post hole digger stand of claim 6 wherein the movable support bar is mounted on movable members slidable along the vertical support arms.

8. The post hole digger stand of claim 7 wherein the movable members comprise a tubular receiver for the movable support bar mounted on a collar that is slidable along one of the vertical support arms.

* * * * *